United States Patent [19]

Weaver et al.

[11] 4,431,487

[45] Feb. 14, 1984

[54] MATRIXING APPARATUS AND METHOD FOR USE IN THE MANUFACTURE OF MOLDED RECORDS

[75] Inventors: Charles A. Weaver, Indianapolis; Donald J. Wierschke, Brownsburg; Gunter John, Indianapolis, all of Ind.

[73] Assignee: RCA Corporation, New York, N.Y.

[21] Appl. No.: 509,595

[22] Filed: Jun. 30, 1983

[51] Int. Cl.[3] ..... C25D 1/10; C25D 17/12

[52] U.S. Cl. ..... 204/5; 204/281

[58] Field of Search ..... 204/5, 281

[56] References Cited

U.S. PATENT DOCUMENTS

| | | | |
|---|---|---|---|
| 2,018,471 | 10/1935 | Russell | 204/281 |
| 3,227,634 | 1/1966 | Rinzema | 204/5 |
| 3,956,075 | 5/1976 | Rohwer | 204/5 |
| 4,400,245 | 8/1983 | Prusak | 204/5 |

*Primary Examiner*—T. M. Tufariello

*Attorney, Agent, or Firm*—Birgit E. Morris; Edward J. Sites

[57] ABSTRACT

In order to provide an improved seal between matrixes and their replicas, as well as eliminating or substantially reducing the problem of premature separation of the replicas from the matrixes, a circumferential spiral groove of a substantially rectangular configuration is cut into the outermost circumferential area of the matrix. The rectangular spiral groove is cut beyond the portion of the matrix which will be used as the molding surface of the stamper. The rectangular groove is substantially larger than the V-shaped groove of audio records and is much larger than the V-shaped grooves used on high density information discs. Because of the larger size and the substantially rectangular geometric configuration of the grooves, the rectangular spiral groove forms a highly effective seal between the matrix and the replica. The electrolyte seal between the replica and the matrix can be even further improved by forming a spiral rectangular groove at the center portion of the matrix in the area which will be removed during the final finishing of the stampers.

9 Claims, 6 Drawing Figures

MATRIXING APPARATUS AND METHOD FOR USE IN THE MANUFACTURE OF MOLDED RECORDS

This invention relates to an improved apparatus and method for use in the matrixing process employed in the manufacture of molded records, and more particularly, is concerned with an improved seal means which prevents electrolyte leakage during electroforming and prevents premature separation of electroformed replicas from the matrixes on which they are formed.

BACKGROUND OF THE INVENTION

In the manufacture of molded records, such as conventional audio records or the more recently developed high density information discs, a plastic material is molded between a pair of metal plates referred to as stampers. The stampers have defined in their molding surface a spiral information track which contains a mirror image of the surface relief pattern which corresponds to the information desired to be molded into the surface of the record.

The stampers used to mold the records are the end product of a multistep replication process known as matrixing. The first step in the matrixing process is to record on magnetic tape or the like the program information desired to be molded into the record. The tape is then used to control a tool which cuts a spiral information track into a flat disc which is referred to as a recording substrate. The recording substrate is generally a metal plate which has a layer of material such as wax, lacquer or a metal such as copper formed on its surface into which the information track is cut.

The recorded substrate having the information track defined in the surface is thereafter replicated. In the first replication step a metal such as nickel is electrodeposited on the surface of the recording substrate until a sufficiently thick layer is deposited so as to make a self-sustaining port, usually about 0.015 inches (0.04 cm) in thickness. The resulting electroformed part, which is referred to as a master, is removed from the surface of the recording substrate. The master which is obtained is essentially a mirror image of the surface of the recording substrate. The master is then in turn replicated by electroforming a metal such as nickel to form a mold. A number of molds are generally formed on a given master. The molds which are obtained are mirror images of the master and are positive copies of the original recording substrate. The molds in turn are themselves replicated to form stampers. The stampers are generally somewhat thinner than the masters and molds being generally about 0.008 inches (0.02 cm) in thickness. If the matrixing process is conducted correctly, the stampers will have defined in their surface a mirror image of the surface relief pattern which is desired to be molded into the record.

In the matrixing process, parts such as the masters and molds are initially formed as replicas and are then themselves used as matrixes, that is a part on which a replica is formed. Since the present invention is generally useful in the matrixing process without specific regard to whether a part is a recording substrate, master, mold or stamper, the term matrix will be used hereinafter to refer to a part which is replicated and the term replica will be used hereinafter to refer to a part which is electroformed on a matrix.

The matrixing process is a highly complex procedure which must be carefully conducted in order to consistently produce satisfactory products. One of the most important considerations in the matrixing process is to prevent the matrix and replica from being stained. Another consideration is to prevent burnout of the parts during the electroforming. One of the principle causes of staining and burnouts has been found to be leakage of electrolyte between the matrix and the replica during electroforming. Another major problem area in the matrixing process is premature separation of the replicas from the matrixes during and immediately after electroforming. This is related in part to the electrolyte leakage problem as it is caused to a large extent by poor sealing of the replica to the surface of the matrix.

The problem of poor sealing of the replica to the matrix is an extremely difficult problem to overcome in that certain required matrixing procedures are in fact a cause of the problem. For example, in the matrixing process the matrixes must be passivated so as to prevent adhesion and possible alloying of the metal which is electrodeposited to form the replica. The matrix and resulting replica are also deliberately designed so they do not have any undercutting or the like which would mechanically interlock the parts and prevent separation after electroforming. In addition, the outer edges as well as the center portions of the stampers are specifically designed to be as smooth as possible, almost mirrorlike, so as to promote the release of molded plastic records from the stampers. Even the recorded areas of the stampers, especially stampers used for the high density information discs, are essentially smooth because of the relative closeness and shallowness of the information tracks in the recorded program area. For example, on a high density information disc there are about 10,000 grooves to the inch, which grooves are only about 19 microinches in depth, so that the surface is in effect smooth.

Various suggestions have been made to reduce or eliminate electrolyte leakage and premature separation of replicas and matrixes. Once such suggestion was to preplate the matrixes with the outer circumferential edge exposed so as to cause preplating over and around the outer edge of the matrix. The preplating over the outer edge of the matrix was intended to form a seal about the outer edge of the matrix and also to form a grip to hold the replica in place on the matrix during and after the electroforming operation. This technique has not proved to be satisfactory. It had limited success in reducing electrolyte leakage and premature separation and further added a separate, time-consuming step to the matrixing process. This technique also caused problems in the separation of the replicas from the matrixes because the extra metal on the outer edges has to be removed either by being cut off or ground off.

It was also suggested to knurl the unrecorded outer edges and also the center of the matrixes so as to provide a grip for the matrix. Knurling, however, did not prove to be a satisfactory solution. It was found that the knurling had to be forced into the replica for a substantial depth in order to have an effect in holding a replica onto the surface of a matrix. The amount and depth of the knurling required resulted in a considerable amounf of metal being displaced in the knurling process which in turn caused distortion of the information track in the recorded area of the replica. A further problem encountered with knurling was that if the knurling was sufficiently deep, it often resulted in deep lines or raised ridges at the outer edges of the molded record which was highly undesirable with regard to using that portion for the lead-in track on the record.

Recently a suggestion was made by John J. Prusak in U.S. patent application Ser. No. 325,955, filed Nov. 30, 1981 which is entitled, "Matrixing Processes for the Manufacture of Molded Records." Prusak suggested the use of a texturized band around the outer diameter and the inner diameter of the record in order to form a seal which would be replicated through the entire matrixing process. The technique suggested by Prusak has proven to be a substantial improvement over the methods heretofore suggested in the art. The Prusak method, however, has not proven to be completely satisfactory in that occassionally electrolyte leaks occur and premature separations are encountered, particularly if the operators are not skilled in the use of the technique disclosed by Prusak.

It would be highly advantageous if an apparatus and method could be provided which would effectively provide an electrolyte seal to prevent leakage of electrolyte between replicas and matrixes as well as prevent premature separation of the replicas from the surface of the matrixes.

BRIEF SUMMARY OF THE INVENTION

In order to provide an improved seal between matrixes and the replicas, as well as eliminating or substantially reducing the problem of premature separation of the replicas from the matrixes, a circumferential spiral groove of a substantially rectangular configuration is cut into the outermost circumferential area of the matrix. The rectangular spiral groove is cut beyond the portion of the matrix which will be used as the molding surface of the stamper. The rectangular groove is substantially larger than the V-shaped groove of the audio records and is much larger than the V-shaped grooves used on the high density information disc. Because of the larger size and the substantially rectangular geometric configuration of the grooves, the rectangular spiral groove forms a highly effective seal between the matrix and the replica. The electrolyte seal between the replica and the matrix can be even further improved by forming a spiral rectangular groove at the center portion of the matrix in the area which will be removed during the final finishing of the stampers.

DETAILED DESCRIPTION OF THE INVENTION

Figure 1:
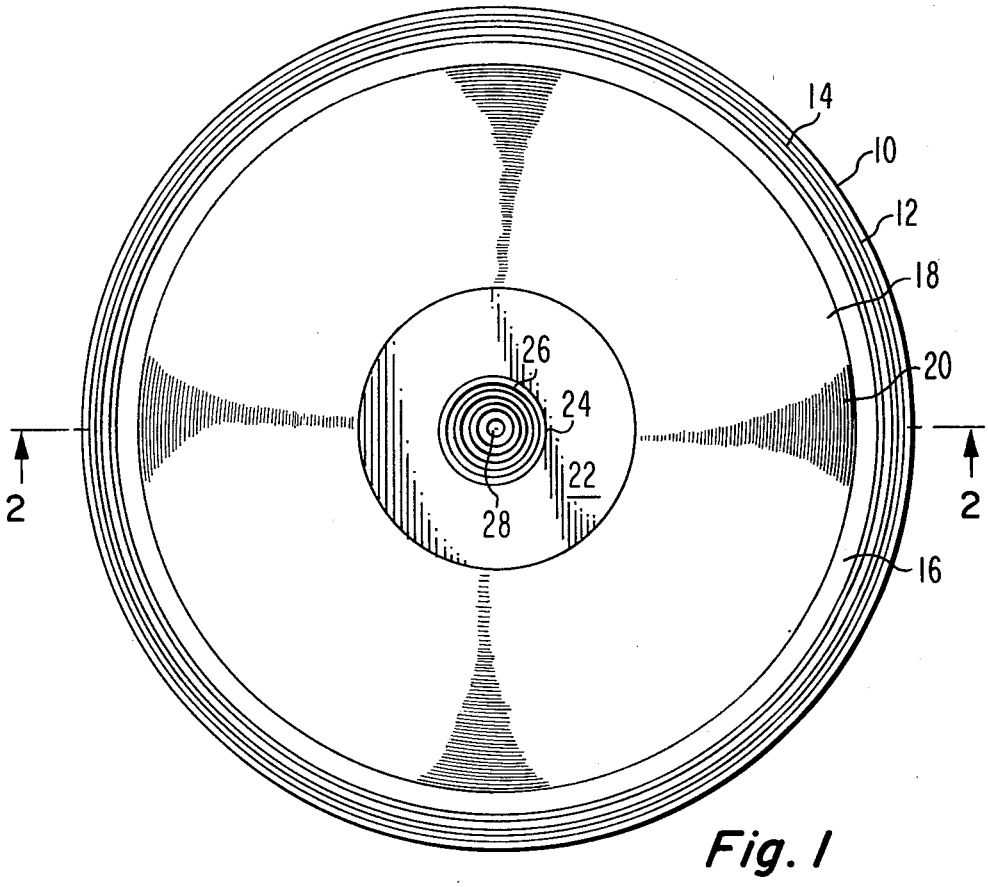
FIG. 1 is a top plan view of a matrix made in accordance with the present invention.
Figure 2:
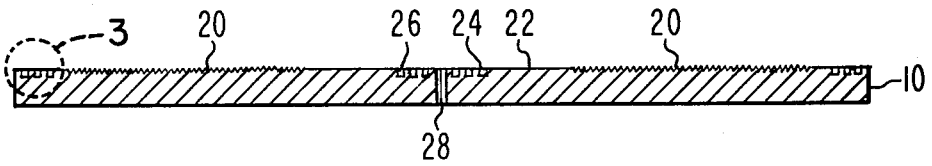
FIG. 2 is a cross-sectional view of the matrix of the present invention taken as indicated by the line and arrow 2—2 on FIG. 1.
Figure 3:
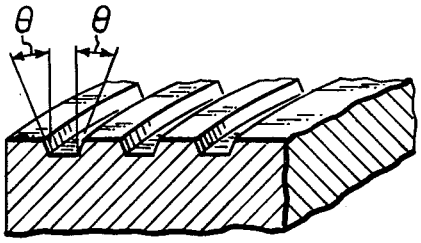
FIG. 3 is an enlarged illustration taken in perspective of the edge section indicated by the dotted area 3 on FIG. 2.

Referring to FIGS. 1 and 2 there is illustrated the matrix 10 of the present invention. The matrix 10 is flat and has a series of distinct circumferential zones 12, 16, 18, 22, 24 defined across the surface of the matrix 10. The outermost circumferential zone 12 has a spiral groove 14 defined therein which is of a substantially rectangular cross-sectional configuration. Immediately adjacent the outermost circumferential zone 12 there is a smooth surface zone 16. The smooth surface circumferential zone 16 extends from the inner edge of the outermost circumferential zone 12 to the start of the recorded zone 18 of the matrix 10. The recorded zone 18 is the most critical zone of the entire matrix 10 as the V-shaped spiral grooves 20 formed in the recorded zone 18 carry the program information desired to be molded into the final record. In the center portion of the matrix 10 there is an unrecorded area 22. Furthermore, as illustrated in FIGS. 1 and 2, the matrix 10 has a centermost section 24 which has defined therein a spiral groove 26 which has a substantially rectangular cross-sectional shape. The use of the center section 24 with its spiral groove 26 is optional and can be omitted if a satisfactory seal can be formed at the center hole 28 of the matrix with a cathode knob or the like. The center section 24, while optional, is preferably used to insure adequate sealing at the center hole 28.

The function of the spiral grooves 14, 26 is to form a liquid tight seal which will prevent electrolyte leakage during electroforming and which will also prevent premature separation of the replica from the matrix. The outermost circumferential zone 12 and more specifically the spiral groove 14 with the rectangular cross section is the effective portion of the seal means as the outer diameter is the most difficult area to seal using the conventional means heretofore employed in the prior art.

As to the specific configuration of the spiral grooves 14, 26 it should be noted as pointed out above that they have a generally rectangular cross-sectional shape. Various combinations of widths and depths as well as pitches of the spiral grooves 14, 26 can be employed to obtain effective sealing of the replica to the matrix. It is believed that it is the spiral and generally rectangular configuration of the sealing grooves 14, 26 which provides the exceptional sealing and gripping capability of the replica to the matrix during electroforming. Accordingly, the various combinations of spiral edge seals with rectangular cross sections are included within the above general description which are effective in forming an electrolyte tight seal are considered to be within the scope of the present invention. It has been found, however, that there are certain combinations of groove depths, groove widths and groove pitches which give an optimum combination of satisfactory sealing of the replica to the matrix during electroforming and also, as importantly, permit the replica to be readily separated from the matrix. It has been found, for example, that the rectangular grooves 14, 26 should be only about 1/10 as deep as they are wide in order to facilitate the separation of the replica from the matrix. The width is likewise an important factor with a width about 2.0 to about 2.5 mils (0.5–0.6 mm) found to be highly satisfactory for the purposes of this invention. To be most effective in both holding the replica and the matrix together during the electroforming and subsequent operations, and also to be effective in releasing the replica from the matrix, it has been found that the walls of the grooves should likewise be cut at a slight relief angle $\theta$ from the perpendicular, with about 4 to 6 degrees being most satisfactory for this purpose. The groove pitch likewise has a distinct effect on the relative amount of sealing which is obtained. In this regard, using the above parameters it has been found that a groove pitch of about 100–125 grooves per inch (39–49 per centimeter) is satisfactory for the purpose of this invention. The width of the outermost zone 14 is likewise highly effective in determining the amount of sealing that is obtained in that the wider the zone to a reasonable width the greater will be the sealing under otherwise equivalent conditions. It has been found that using the general size parameters for the groove width, depth and pitch noted above that if the outer circumferential zone 12 of the matrix 10 is at least about 0.50 inches in width (1.3 cm) that the excellent results can be obtained without making the matrix 10 excessively large in diameter. The above noted specified dimensions have been found to be especially effective in the method and apparatus of the present invention, but the present invention is not limited to the above dimensions and can be used with other combinations of groove widths, depths and pitches provided satisfactory sealing results are obtained.

The remainder of the circumferential zones of the matrix 10, that is, the smooth outer zone 16, the recorded zone 18 and the center section 22 are conventional in nature and as such do not require any detailed description.

Figure 4:
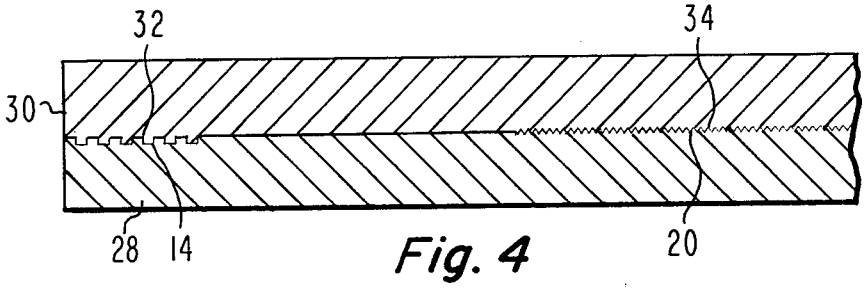
FIG. 4 is a cross-sectional illustration of a portion of the matrix and the replica formed on the surface of the matrix.
Figure 5:
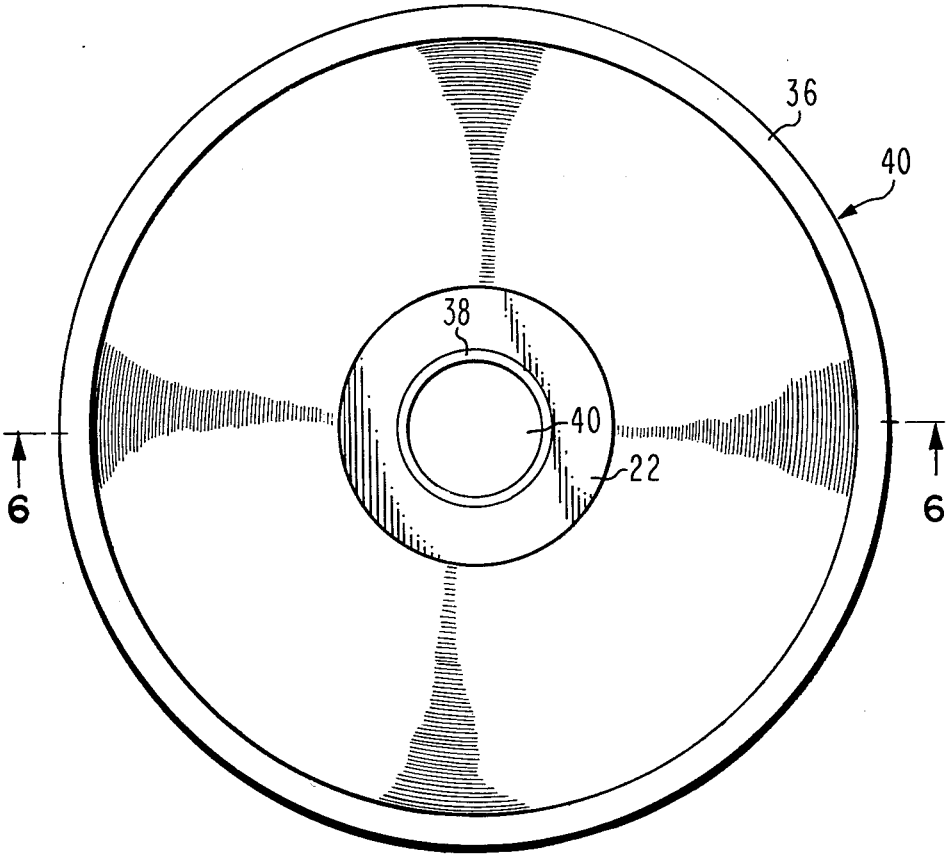
FIG. 5 is a top plan view of a stamper made in accordance with the present invention.
Figure 6:
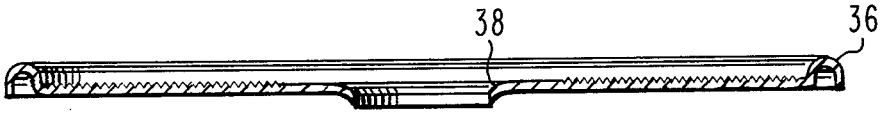
FIG. 6 is a cross-sectional configuration of the stamper of FIG. 5 taken as illustrated by the lines and arrows 6—6 of FIG. 5.

In the matrixing method of the present invention, it is preferable to cut the spiral rectangular groove 14 in the outermost zone of the recording substrate, as the groove will thereafter be reproduced as either a positive or negative groove in each of the succeeding replicas. The same technique is also preferred if a center grooved section 24 is used with the matrix 10, in that the groove 26 of the grooved center section 24 will likewise be reproduced in the subsequent matrixing steps. This is best seen in FIG. 4 wherein the matrix 28 has a replica 30 formed on the surface thereof. As can be seen in FIG. 4, the groove 14 formed in the matrix 28 is reproduced in the replica as a mirror image groove 32 which is of the same general rectangular configuration. The same effect is obtained with regard to the recorded area where the groove 20 of the matrixes are reproduced as their mirror image in the replica 30 as the grooves 34. It is also possible to add the spiral rectangular groove at a later point in the matrixing process, for example, to cut the spiral grooves 14, 26 into the master or the mold and still obtain certain of the advantages of the present invention.

To convert the flat electroformed stamper blank into a usable mold stamper, the outer diameter is trimmed to the required size which results in the removal of the outermost circumferential area 12 containing the substantially rectangular spiral groove 14. The center section 22 is also trimmed, which removes the grooved section 24 in the center thereof. An inner coin 38 is formed about the center hole 40. In a similar manner, the smooth intermediate zone 16 is then coined to provide a raised molding land 36. The stamper 42 thus obtained is now ready for mounting in use in a record molding press.

It has been found that using the matrix with the improved edge seal of this invention that the matrixing process is significantly improved. There is no staining or leakage of electrolyte encountered in the matrixing process and there is virtually no premature separation of the replicas from the matrixes. The result is a substantially higher yield of stampers using the method and apparatus of the present invention.

What is claimed is:

1. In a record matrix for use in the electroforming of a replica on a recorded surface of the matrix in which the recorded surface of the matrix has an unrecorded center portion; a radially extending circumferential recorded portion which is contiguous with and surrounding the unrecorded center portion and an unrecorded circumferential zone contiguous with and extending radially outward from the recorded zone, the improvement which comprises; forming a circumferential seal zone contiguous with the unrecorded circumferential zone, said seal zone being of a predetermined width and having defined therein a substantially rectangular spiral groove of a given groove width, a given groove depth and a given groove pitch chosen so as to form an electrolyte tight seal of the replica to the surface of the matrix.

2. The matrix according to claim 1 wherein the centermost area of the matrix has defined therein a substantially rectangular cross-sectional spiral groove of said given groove width, said given groove depth and said given groove pitch.

3. The matrix according to claim 1 wherein the given depth is about 1/10 the given width of the rectangular groove.

4. The matrix according to claim 1 wherein the given groove width is about 2 to 2.5 mils (0.05–0.06 cm) in width.

5. The matrix acccording to claim 1 wherein the walls of the substantially rectangular groove are relieved from the perpendicular by about 4 to 6 degrees.

6. The matrix according to claim 1 wherein the given groove pitch is about 100–125 grooves per inch (39–49 per cm).

7. The matrix according to claim 1 wherein the predetermined width of the seal zone is at least about 0.5 inches (1.3 cm).

8. The method for forming a stamper for molding records which comprises electroforming a metal on a recorded surface of a matrix, wherein the recorded surface includes an unrecorded portion, a radially extending circumferential recorded portion which is contiguous with and surrounds the unrecorded center portion and an unrecorded circumferential zone which is contiguous with and extends radially outward from the recorded zone and which further includes a circumferential seal zone contiguous with the unrecorded circumferential zone, with said seal zone being of a predetermined width and having defined therein a substantially rectangular spiral groove of a given groove width, a given groove depth and a given groove pitch, chosen to form an electrolyte tight seal of the metal electroformed on the recorded surface of the matrix; depositing sufficient metal to form a stamper; removing the stamper from the recorded surface of the matrix; trimming the seal zone from the outer diameter of the stamper and thereafter coining the outer and inner edges of the stamper.

9. The method according to claim 8 wherein the centermost area of the matrix which is employed has defined therein a substantially rectangular spiral groove of said given groove width, said given groove depth and said given groove pitch and is of a total diameter less than the center coin of the stamper and wherein the centermost area is removed prior to coining.

* * * * *